United States Patent [19]

Pate et al.

[11] 4,340,547

[45] Jul. 20, 1982

[54] PROCESS FOR CONCENTRATING A FLOW OF LIPIDS IN SOLVENT

[75] Inventors: Daniel R. Pate, Strongsville; Robert R. Delaney, Medina; John J. Shuleva, Parma, all of Ohio

[73] Assignee: SCM Corporation

[21] Appl. No.: 269,750

[22] Filed: Jun. 2, 1981

Related U.S. Application Data

[63] Continuation-in-part of Ser. No. 129,182, Mar. 10, 1980, abandoned.

[51] Int. Cl.[3] ..... C09F 5/10; C11B 3/00

[52] U.S. Cl. ..... 260/428.5; 23/295 R; 210/737; 210/774

[58] Field of Search ..... 23/295 R, 296; 62/536, 62/545; 210/702, 737, 774; 260/428.5; 422/245, 250, 254

[56] References Cited

U.S. PATENT DOCUMENTS

| | | | |
|---|---|---|---|
| 2,288,667 | 7/1942 | Allen et al. | 23/295 R |
| 2,823,242 | 2/1958 | McKay | 210/774 |
| 2,910,363 | 10/1959 | Rubin et al. | 260/428.5 |
| 2,972,541 | 2/1961 | Cochran et al. | 426/313 |
| 3,345,389 | 10/1967 | Zilch | 260/428.5 |
| 3,474,636 | 10/1969 | Bligh | 62/532 |
| 3,660,043 | 5/1972 | Schildknecht et al. | 422/254 |
| 3,755,390 | 8/1973 | Viarengo et al. | 260/428.5 |
| 4,010,183 | 3/1977 | Quesada | 260/428.5 |
| 4,129,583 | 12/1978 | Zondek | 260/428.5 |
| 4,235,796 | 11/1980 | Paulicka | 260/428.5 |
| 4,257,796 | 3/1981 | Arkenbout | 62/538 |

*Primary Examiner*—Peter A. Hruskoci
*Attorney, Agent, or Firm*—Richard H. Thomas

[57] ABSTRACT

A feed of lipid and solvent is concentrated in a chamber by establishing and maintaining within a chamber a net major flow and a separate and distinct net minor flow. A net transfer of solid phase lipid is effected from the major internal flow to the minor internal flow thereby concentrating the minor flow. However, the minor flow is preferably essentially all in liquid phase when it is withdrawn from the chamber.

25 Claims, 3 Drawing Figures

PROCESS FOR CONCENTRATING A FLOW OF LIPIDS IN SOLVENT

This patent application is a continuation-in-part of U.S. Ser. No. 129,182, filed Mar. 10, 1980, now abandoned.

BACKGROUND OF THE INVENTION

The present invention is a flow process for producing a concentrated flow of lipids in solvent. Lipids are frequently dissolved in solvent during processing designed to separate the lipids into two or more usable fractions. Such processes are often referred to as fractional crystallization separations and are generally comprised of dissolving the lipid in a solvent, cooling the resulting solution until the desired crystalline fraction is formed, and then separating the crystalline fraction from the remaining liquor. The resulting fractions of lipid in solvent are concentrated by filtering, settling, or evaporating the solvent. These concentrating methods are all very expensive and require expensive equipment to be effective. The present process provides a method for significantly reducing the expense of separating the lipids from solvent thereby producing a concentrated lipid flow.

In accordance with invention principles, a product stream enriched in lipids is produced from a feed stream leaner in same. A chamber with a feed inlet means intermediate to outlets remote therefrom can be used. Internal net flows are established in the chamber, one being depleted of lipid as it travels towards its particular outlet; another being a product flow enriched in lipid as it travels to its outlet by virtue of a net lipid transfer from said first flow. The feed stream preferably is a solution of lipid solute in solvent, the internal flows for the most part are mixtures of solid phase lipid in a vehicle of solution; however, the product flow preferably is totally in liquid phase. The conditions for establishing and maintaining aforesaid conditions are set forth hereinafter.

One advantage of the present invention is that a flow of lipids in solvent can be concentrated without the expensive equipment heretofore required. Another advantage is that the lipid composition as well as the lipid concentration in the flow of the present process can be controlled by controlling the composition of the feed and the composition of the precipitates transported into the product flow. A still further advantage is that the present process operates with a lower energy requirement than previous concentrating processes for lipids in solvent. Yet another advantage of the present process is that it can be integrated with a fractional crystallization separation in a very efficient fashion. These and other advantages will be apparent from the detailed description of the invention.

BROAD STATEMENT OF THE INVENTION

The present invention is a flow process for concentrating a flow of lipid in solvent therefor. Lipid and solvent in fluent condition are fed into a chamber intermediate to major and minor outlets from the chamber. A major internal net flow proceeds toward the major outlet, and a minor internal net flow proceeds toward the minor outlet, creating a zone of major internal net flow and a separate and distinct zone of minor internal net flow. The temperature of the major internal net flow is controlled such that at some point within the chamber it is below the temperature at which a portion of the lipid will precipitate in solid phase therefrom. Solid phase lipid present in the zone of major flow is admitted into the zone of minor flow; the temperature of the minor flow about the minor outlet being sufficiently elevated to at least partially redissolve or remelt the admitted solid phase lipid. The flows thereby created out of the chamber are a major flow depleted of a portion of its lipid and a minor flow enriched in lipid and thus concentrated.

DESCRIPTION OF THE DRAWINGS

FIG. 1 shows a configuration where the intermediate points from which the major flow and the minor flow originate are essentially the same point. This schematic is representative of the situation where a single feed of lipids in solvent is divided into a major flow and a minor flow within the chamber. FIG. 2 represents the configuration where a lipid-containing feed is introduced into the chamber and proceeds in substantially one direction within the chamber as a major flow, and a second liquid is introduced at a second intermediate point and flows in a direction essentially opposite to the lipid-containing feed, the second liquid flow being the minor flow.

In each case, precipitates present in the major flow are transported within the chamber to the region of minor flow where said precipitates are at least partially redissolved and become part of the minor flow thus concentrating the minor flow.

Figure 3:
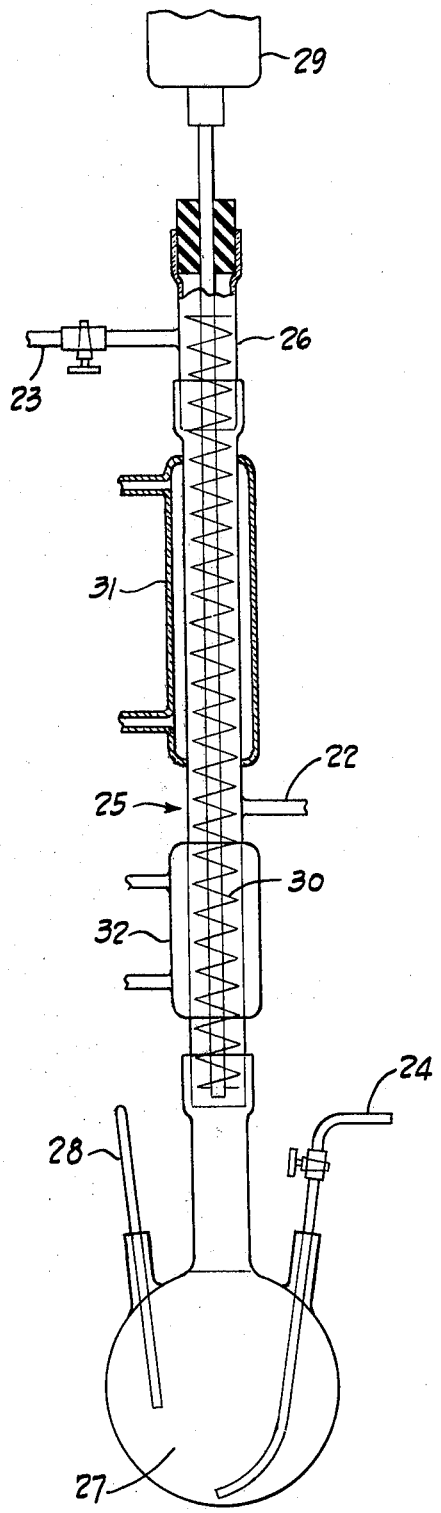

FIG. 3 is a drawing of a glassware apparatus useful for carrying out the instant process. The apparatus of FIG. 3 operates using the flows shown schematically in FIG. 1.

DETAILED DESCRIPTION OF THE INVENTION

The present invention is a flow process. The term "flow process" as used herein means a net flow process. Momentary interruptions of any of the flows of the present process can be tolerated. Even substantial interruptions in some flows can be tolerated, especially in the minor flow, when such interruption does not interfere with the net flows of the process.

Figure 1:
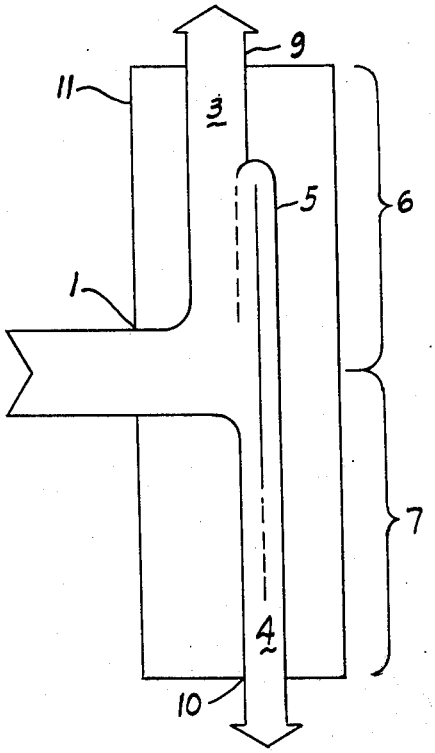
FIG. 1 and FIG. 2 are schematic drawings of two possible configurations of the flows of this process.

Referring to FIG. 1, a lipid-containing feed enters the chamber 11 through inlet 1 and the major flow 3 of this feed proceeds in a generally upward direction through major net flow region 6. The temperature of major flow 3 is controlled so that lipid precipitates are present in the flow within chamber 11. At least a portion of these precipitates remain in the chamber and are conveyed from the major flow region 6 to minor flow region 7 as shown by flow 5. The temperature of minor flow 4 in region 7 is controlled so that the precipitates in flow 5 are at least partially redissolved and/or remelted in minor flow 4. Major flow 3 is withdrawn from the chamber at outlet 9 depleted of a portion of its lipid content. Minor flow 4 is withdrawn from the chamber at outlet 10 enriched in lipid content. The minor flow 4 thus becoming a concentrated lipid flow.

Figure 2:
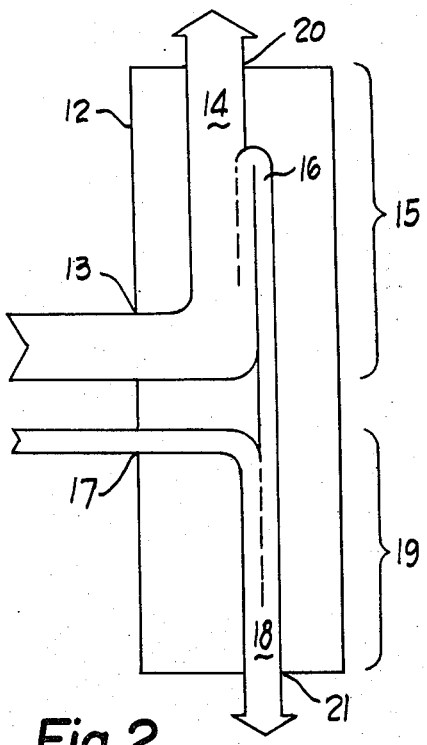

Referring now to FIG. 2, lipid-containing feed enters chamber 12 at point 13 and substantially all of the lipid feed becomes part of the major net flow 14. The temperature of the major net flow 14 is controlled so that lipid precipitates are present in the flow within chamber 12. At least a portion of the lipid precipitates are retained in chamber 12 and are transported as shown by flow 16 from region 15 of major net flow 14 to region 19 of minor flow 18. A second flow of liquid originates from intermediate point 17 and forms part of flow 18 through chamber 12. In region 19 minor flow 18 is joined by the lipid precipitates in flow 16 where the minor flow is warmed to at least partially redissolve the lipid precipitates. Major flow 14 is withdrawn from outlet 20 depleted of a portion of its lipid content. Minor flow 18 is withdrawn from outlet 21 and is enriched in lipid content.

Referring now to FIG. 3, FIG. 3 is a drawing of a glassware apparatus suitable for use in the present process. Chamber 25 is a custom-built, center-feed condensor with individual cooling (or heating) jackets 31 and 32 on either side of an inlet tube 22. Standard taper male and female joints are located on the top and bottom of the chamber to allow mating to other parts of the apparatus. A side valve outlet adapter 26 having the same internal diameter as chamber 25 and a side valve outlet 23 is fitted to the taper joint at the top of chamber 25. Flask 27 is a three-neck, 500-ml. flask with a thermometer 28 fitted in one neck, a siphon tube 24 fitted in the second neck, and the third neck having the same I.D. as chamber 25 fitted to the taper joint at the bottom of chamber 25. A spiral scraper 30 is constructed from an extended flat wire spring attached to a $\frac{1}{8}''$ steel shaft. The scraper is rotated by a variable speed motor 29 at speeds between about 6 and about 10 RPM. The scraper extends from the top of the side valve outlet adapter 26 to the bottom of chamber 25.

During operation lipids in solvent are introduced into chamber 25 through inlet 22. A major flow of the lipid-containing feed passes upward in chamber 25 and is withdrawn through outlet 23. A minor flow of the feed passes downward in chamber 25 and is withdrawn through siphon tube 24. Chilled liquid coolant passes through the upper cooling jacket 31 on chamber 25 and is controlled to maintain the temperature of the major flow as it reaches the major flow outlet 23 such that at least a portion of the lipid contained in the feed is in the form of precipitates. Lipid precipitates are transported by gravity from the region of major flow (between inlet 22 and outlet 23) to the region of minor flow (between inlet 22 and siphon 24). Spiral scraper 30 rotates and prevents precipitates from sticking to the walls of chamber 25, and also possibly provides some downward thrust to the precipitates.

Heat is supplied to the bottom of flask 27 by an external heater (not shown) which causes substantial redissolution and/or remelting of lipid precipitates into the minor flow. The minor flow is thus enriched in lipids and becomes a concentrated lipid flow.

A wide variety of lipids are suitable for use in the present process. Such lipids include selectively hydrogenated glyceride oil as shown in U.S. Pat. No. 2,972,541. Further suitable lipids include randomized and corandomized glyceride oils. Additional lipids include monoesters of glycerine and propylene glycol and admixtures with related esters thereof such as shown in U.S. Pat. No. 4,010,183. Further lipids include fat-forming acids, other various esters of fat-forming acids, and fatty alcohols, including those derived from animal, vegetable (including nuts), tall oil, and mixed sources. Other than the acids per se, such lipids all embody combined esters of $C_2$ to $C_{26}$ fat-forming acids and preferably $C_8$ to $C_{22}$ fat-forming acids which can have varying degrees of unsaturation. Typical of such fat-forming (or "fatty") acids include these acids: lauric, myristic, palmitic, oleic, stearic, butyric, linoleic, behenic, elaidic, and like fatty acids. Such acids in the cis-conformation normally are found in natural glyceride oils, fats, and tall oil. Typical glyceride oils include the oils called peanut, coconut, cottonseed, corn, soybean, sunflower, lard, tallow, palm kernel, palm, sal fat, shea fat, mahua, bacury, so-called "low molecular" fats, and the like, and mixtures thereof. The lipids can be deodorized conventionally, e.g., by steam deodorization, or lipids can be used in the instant process without such deodorization.

Solvents suitable for use in the instant process are fugitive for separation as a vapor from the residual lipid. For present purposes, a solvent is fugitive if it has a normal boiling point at one atmosphere total pressure of not substantially above 250° C., advantageously not substantially above about 200° C., and preferably not substantially above about 150° C. The solvent should also be one that will dissolve the lipid to at least about 10 grams per 100 cc, at a temperature not substantially above 70° C., which solvent also has less solubility for the lipid and particularly for saturated (and higher melting) components thereof as the temperature of the solution is reduced. Additionally, this solvent is advantageously restricted to one having an appreciable differential in density from said lipid of at least about 0.05 g/cc, and preferably about 0.1 g/cc. A solvent having a density less than the density of the lipid is preferably used in the present process when the major net flow described in this process is in a generally upward direction and the minor net flow is in a generally downward direction. A solvent which has a density greater than the density of the lipid is preferably used where the major net flow is in a downward direction and the minor net flow is in an upward direction. The density differential in the preferred conditions allow lipid precipitates to be conveyed at least in part by gravity.

Solvents useful in the present process having a density substantially less than the lipid include acetone, ethanol, hexane, heptane, methanol, methylethyl ketone, and the like. Those solvents having a density substantially greater than the lipid include halogenated solvents such as carbon tetrachloride and chloroform, dimethyl sulfone, 1-nitro-propane, 2-nitro-propane, n-methyl pyrrolidone, and the like. Most lipids have a density which normally ranges from between about 0.925 to about 0.970 g/cc, thus some of the listed solvents will be preferred for some lipids while being merely suitable for other lipids. The preferred solvents for use in the present process include acetone, methanol, hexane, ethanol, methylethyl ketone, and 2-nitropropane.

The lipid:solvent ratio of the feed should be between about 2:1 and 1:20 parts by weight, and preferably between about 1:2 and 1:12 parts by weight.

The chamber used for practicing the present process can be of any suitable size and shape. The size of the chamber will be determined primarily by the output desired from the process. The chamber is preferably elongated in a vertical direction or a substantially vertical direction and has few if any substantial obstructions or constrictions on its interior surfaces. The chamber must have two outlets distant from each other. The outlets are preferably located at or near the vertical ends of the chamber, that is one outlet located at or near the top of the chamber and one outlet located at or near the bottom of the chamber. The chamber also should have one or more inlets located intermediate to the outlets. The size and configuration of the inlets and outlets and chamber can be determined from the flows through said inlets, outlets, and chamber that will be required to operate the process for the desired service.

The chamber should be constructed of materials which are nonreactive and noncorrosive with the solvent and lipids to be introduced into the chamber. Glass and austenitic stainless steel have proven to be suitable materials for construction of the chamber.

An efficient way to start up the present process is to fill the chamber with solvent. The major flow of lipid solution is then created by introducing lipids in solvent into an inlet and withdrawing solution at essentially the same rate from one of the outlets. The preferred direction of the major flow within the chamber is determined by the relative densities of the lipids and solvent being introduced into the chamber. If the lipids are more dense than the solvent, the major flow preferably will proceed in a generally upward direction through the chamber. This is the case when acetone, methylethyl ketone, or the like are used as solvent. If the lipids are less dense than the solvent, the major flow preferably is in a generally downward direction.

The minor flow can then be created by withdrawing solution from the second outlet as shown schematically in FIG. 1. The portion withdrawn from the second outlet should be smaller than the portion withdrawn from the first outlet; the total amount withdrawn from the two outlets being essentially equal to the amount introduced into the inlet. The minor flow thus created will be in a direction essentially opposite to the direction of the major flow and originating at a common intermediate point.

An alternate method of creating the minor flow is to introduce a small proportion of a second liquid into a second intermediate inlet in the chamber and withdrawing a flow at essentially the same rate from the second outlet as shown schematically in FIG. 2. The second inlet should be intermediate to the first inlet and second outlet. In this manner, a major flow is created between a first inlet and a first outlet and a minor flow is created between a second inlet and a second outlet, the flows again being in substantially opposite directions within the chamber. In this case, there will be a zone of indeterminate flows between the first and second inlets to the chamber. The flows in this zone can be upward, downward, neither, or both. Preferably the second liquid is relatively pure solvent similar to the solvent used in the lipids-in-solvent feed; however, the second liquid can also contain some lipids or be similar to the lipids-in-solvent feed.

The temperature of the major flow is controlled so that lipid precipitates will be present in the major flow within the chamber. This temperature control can be accomplished by any convenient and efficient means. One effective means for controlling the temperature of the major flow is to pass a temperature-controlled liquid through a jacket surrounding the major flow region of the chamber.

In one aspect of the present invention, the lipids-in-solvent feed is an apparent solution, and all of the precipitates present in the major flow form within the chamber. In this embodiment the temperature-controlled liquid is a refrigerated coolant and an integrated fractional crystallization separating and concentrating process is produced.

In another embodiment of the present invention a slurry of preformed lipid crystals in solvent can be used as the lipids-in-solvent feed. According to this aspect of the present invention, the feed temperature need only be maintained; however, slight warming or cooling can take place so long as some lipid precipitates continue to be present in the major flow region.

If precipitates are to be formed primarily within the chamber, the lipid feed preferably should be at a temperature only slightly above the temperature required for all the lipids to be dissolved in the solvent. The rate of cooling of the major flow within the chamber should be controlled to prevent shock cooling and at the same time obtain substantial cooling of the lipid feed as it passes through the region of major flow in the chamber. Substantial cooling as used herein refers to a degree of cooling that is effective to not only lower the temperature of the solution, but also cause the formation of some precipitates. Cooling at a rate of about 1° C. per minute has been found effective for the present service. However, cooling from about 0.2° C. to about 6° C. per minute can also be advantageously used. Cooling at rates in excess of about 10° C. per minute should be avoided as shock cooling will result. Also, cooling at rates slower than about 0.1° C. per minute should similarly be avoided as the chamber would have to be unreasonably large in this case to accomplish the substantial cooling required.

Cooling of the major flow within the chamber reduces the solubility of the lipids in the solvent. The portion of the lipids which precipitate is the less soluble portion of the lipids. By cooling the major flow in a controlled fashion, the lipid precipitates tend to form and grow in a regular manner occluding impurities and undesired components.

Precipitates which form in the major flow region of the chamber continue to grow the entire time they are in the major flow region of the chamber regardless of the direction they are moving at the time. This has been found to be a particularly advantageous method of forming lipid precipitates because the precipitates are constantly being contacted by a flow of relatively fresh lipid solution. These precipitate-forming conditions are substantially different from the forming conditions that are encountered in other "fractional crystallization" processes where lipids are crystallized from a relatively static solution or even an agitated solution, because in these other processes, the crystallization of lipids continually depletes the surrounding lipid solution of crystallizable lipid and thus the further formation of lipid crystals becomes more and more difficult with time. The present flow process avoids these problems of continual depletion of the surrounding lipid solution by forming precipitates in contact with a flow of feed. At least a portion of the precipitates in the major flow region of the chamber must remain in the chamber and not be carried out through the major flow outlet. A filter or screen can be placed across the major flow outlet to prevent larger precipitates from exiting through the outlet. Also, the cross-sectional area of the chamber can be increased in a zone immediately adjacent to the major flow outlet to slow down the flows in that zone. This will reduce the force exerted by the flow on the precipitates and make it easier for precipitates to stay in the chamber and begin to move counter to the major flow.

Under the preferred density and flow conditions, gravity tends to move liquid precipitates counter to the major flow in the chamber toward the region of minor flow. At least a portion of the lipid precipitates in the major flow are transported to the region of minor flow.

Advantageously, these lipid precipitates represent at least about 10% of the total lipid content of the major flow, and preferably at least about 25%. Gravity can be used as the only transporting force under preferred conditions; however, precipitates can also be physically assisted in their transport from the region of major flow to the region of minor flow such as by a screw conveyor or like means. Upon entering the region of minor flow the precipitates are moving at a rate faster than the minor flow. These precipitates are also moving substantially codirectional with the minor flow.

After entering the region of minor flow, the precipitates and surrounding liquid are warmed to cause at least partial remelting and/or redissolution of the lipid precipitates into the minor flow. Advantageously, the remelting and/or redissolving of the lipids in the minor flow is substantial, and preferably all or almost all of the lipids in the minor flow are remelted and/or redissolved. Any convenient means for adding the necessary heat can be employed. However, because of the presence of volatile solvents, the use of electrical resistance heating means should be avoided because of the explosion and fire hazard. One convenient method of adding the necessary heat to this region of the chamber is running a heated liquid through a jacket or coil surrounding this region of the chamber.

The present process creates a minor flow relatively more concentrated in lipids than the initial lipid feed introduced into the chamber. This concentrating effect is surprisingly enhanced by the flow relationships in the process. This surprising flow effect can be shown by operating the present invention such that the warmed concentrated output from the minor flow outlet is less dense than the lipid depleted output from the major flow outlet. Even when the major flow is generally upward and minor flow is generally downward and no physical conveying means is utilized, the minor flow continues to be concentrated even though the density of the liquid in the chamber decreases as you move downward in the chamber.

One particularly advantageous way of operating the present process is to coordinate the temperature control of the major flow and the warming of the minor flow to provide a substantially continuous temperature gradient throughout the chamber. This has been found to be a particularly efficient method of operating the process and facilitates maintaining the flows and inhibiting blockages from forming in the chamber due to temperature and/or related density fluctuations.

The warming of the minor flow region also is believed to produce a refining of the lipids that move through this region. This may be a reflux-type refining. The temperature and density gradients in this region, together with convective forces and displacement by falling crystals provide driving forces for refluxing back flow. The actual existence of such back flow has not been confirmed. However, even if present, the back flow is not sufficient to interfere with the overall minor flow in the region.

During operation of the process the major flow is withdrawn from the chamber at the rate at which it reaches its outlet. The rate of withdrawal will be slightly less than the rate of input for the major flow, the difference being made up by precipitates which are conveyed out of the major flow and into the minor flow within the chamber. In related fashion the minor flow is withdrawn from the chamber at a rate slightly in excess of the rate of input for the minor flow; the excess being substantially equal to the amount of lipid precipitates which join the minor flow, but originate in the major flow.

The withdrawn materials differ not only in their respective concentrations of solvents and lipids, but also in the composition of the lipids contained in each withdrawn flow. The major flow has a greater proportion of solvent and its lipid portion is made up primarily of more soluble lipids. The minor flow is made up of a smaller proportion of solvent and its lipid portion is composed primarily of less soluble lipids.

The following examples will show ways in which the present invention has been practiced. The examples should not be construed as limiting of the invention. In the examples all parts are expressed in parts by weight and all temperatures in degrees Centigrade.

EXAMPLE 1

A lipid solution was made up of one part of partially hydrogenated cottonseed oil (lipid) and 12 parts acetone (solvent). The lipid and acetone were blended together with agitation and heated until a complete solution was formed. The solution was then rapidly cooled to about 30° C. The apparatus shown in FIG. 3 was filled with pure acetone and then the lipid solution was introduced into inlet 22 at a rate of about 5 ml/min. A minor flow of about one ml/min. was withdrawn from siphon tube 24, and a major flow of about four ml/min. was withdrawn from side valve outlet 23. Ethylene glycol cooled to about −10° C. was introduced into the top of the upper cooling jacket and withdrawn from the bottom of the upper cooling jacket to control the temperature of the major flow. Ethylene glycol at about 30° C. was introduced into the top of the lower cooling jacket and withdrawn from the bottom outlet of the lower cooling jacket to maintain a smooth temperature gradient through that zone of the chamber. An external electric heater supplied heat to the bottom of the column causing warming in that region and through convection up into the column to cause redissolution and/or remelting of falling lipid precipitates.

The major flow was cooled to about 18° C. before exiting from the upper outlet in the chamber. Maintaining this temperature caused the formation of lipid precipitates in the major flow which began to fall and could be observed visually through the glass. The lipid precipitates would fall rapidly past inlet 22 and enter the minor flow region where they disappeared by redissolving and/or melting. The concentrating effect taking place in the minor flow region could be visually observed in this glass apparatus. The solution near the feed point was essentially clear and became increasingly hazy as it proceeded through the minor flow region to the outlet for the minor flow.

The solvent:lipid ratio in the major flow output from the chamber was about 14 parts solvent to 1 part lipid. The solvent:lipid ratio in the minor flow output was about 7 parts solvent to one part lipid. Using the solvent:lipid ratio and temperature, the density of the major flow output liquid, the feed liquid, and the minor flow output liquid were determined. These densities were 0.806, 0.793, and 0.792, respectively. This demonstrates that the concentrating of the minor flow was due to the flow relationships and not the density relationships (common settling) because this density gradient would tend to oppose concentration of the minor flow.

The fatty acid content (FAC), the calculated iodine value (I.V.) and the Mettler dropping point of the feed lipid and lipid in the major flow and the lipid in the minor flow were determined. These values are shown in Table I.

TABLE I

| | | Lipid in Feed | Lipid in Withdrawn Major Flow | Lipid in Withdrawn Minor Flow |
|---|---|---|---|---|
| FAC | 16:0 | 23.4 | 20.1 | 24.6 |
| | 18:0 | 11.5 | 8.5 | 13.7 |
| | 18:1 | 60.4 | 64.4 | 57.5 |
| | 18:2 | 3.1 | 4.3 | 3.3 |
| Calculated I.V. | | 57.8 | 63.5 | 54.8 |
| Mettler Dropping Pt. | | 42.7 | 37.2 | 45.0 |

EXAMPLE 2

In this example, Sal Fat was fractionated into 2 fractions. This example is designed to illustrate the usefulness of the present invention where it is desired that a large proportion of precipitates be formed compared to the feed material. In this example, the proportion of Sal Fat feed which formed precipitates and was concentrated by the present invention represented about 71% of the total feed of the Sal Fat.

One part of Sal Fat was blended with 5 parts of acetone and agitated and heated until a complete solution was formed. Beginning with the apparatus shown in FIG. 3, filled with acetone the Sal Fat solution was introduced into inlet 22 at a rate of about 15 ml/min. A minor flow of about 4 ml/min. was withdrawn from siphon tube 24 and a major flow of about 11 ml/min. was withdrawn from side valve outlet 23. The temperature in the major flow region was controlled as described in Example 1 so that the temperature reached by the Sal Fat solution in the major flow was reduced to about 5° C. prior to withdrawal. The temperature in the minor flow region was controlled as described in Example 1 so that the minor flow was warmed to a temperature of about 33° C. prior to withdrawal from the apparatus.

The solvent/lipid ratio in the major flow output was measured to be about 12.5:1. The solvent-lipid ratio in the minor flow output was measured to be about 4.4:1. It is believed that equilibrium was not achieved during this experiment and, therefore, the solvent/lipid ratios are both solvent-rich due to solvent pickup from the initial pure solvent charge in the chamber.

The Fatty Acid Content (FAC), the Calculated Iodine Value (I.V.), and the Solid Fat Index (SFI) of the feed lipid, the lipid in the major flow and the lipid in the minor flow were determined. These data are shown in Table II. It is readily apparent from the SFI values for the lipid in the minor flow that this material has potential applications in the manufacture of chocolate and chocolate-like products.

TABLE II

| | | Lipid in Withdrawn Minor Flow | Lipid in Withdrawn Major Flow | Sal Fat in Feed |
|---|---|---|---|---|
| FAC | 14:0 | trace | 0.1 | — |
| | 15:0 | trace | 0.1 | 0.1 |
| ISO | 16:0 | — | trace | — |
| | 16:0 | 5.7 | 7.6 | 6.2 |
| | 16:1 | — | 0.1 | — |
| | 17:0 | 0.1 | 0.2 | 0.2 |
| | 18:0 | 48.1 | 32.7 | 43.5 |
| | 18:1 | 38.2 | 50.8 | 41.3 |
| | 18:2 | 1.1 | 2.7 | 1.8 |
| | 20:0 | 6.8 | 4.7 | 6.9 |

TABLE II-continued

| | | Lipid in Withdrawn Minor Flow | Lipid in Withdrawn Major Flow | Sal Fat in Feed |
|---|---|---|---|---|
| | 18:3/20:1 | — | 1.0 | — |
| Calc. I.V. | | 34.8 | 50.2 | 38.6 |
| % Dihydroxy Acids | | 0.16 | 1.67 | — |
| % Epoxy Acids | | 0.02 | 0.15 | 0.03 |
| SFI @ °F. | | | | |
| | 50 | 84.7 | 17.6 | NA |
| | 70 | 82.0 | 3.0 | NA |
| | 80 | 78.8 | 3.0 | NA |
| | 92 | 46.7 | 1.6 | NA |
| | 100 | 1.1 | 1.0 | NA |
| | 110 | — | — | NA |
| Mettler Dropping Point | | 36.9° C. | NA | 35.2° C. |

What is claimed is:

1. A flow process for concentrating lipid and solvent therefor, said lipid being precipitable in solid phase from solution of same in said solvent, which comprises:

feeding lipid and solvent in fluent condition into a chamber having major and minor outlets, the feeding being intermediate to said outlets, and there being not substantially more than about 20 parts by weight solvent per part lipid;

withdrawing lipid and solvent from said outlets, the amount of lipid and solvent withdrawn from said major outlet being greater than the amount of lipid and solvent withdrawn from said minor outlet thereby establishing within said chamber a major net flow of lipid and solvent directed toward said major outlet and a minor net flow of lipid and solvent directed toward said minor outlet;

establishing temperature of said major net flow below the temperature at which a portion of said lipid therein will precipitate in solid phase therefrom, as said major net flow approaches said major outlet;

transporting solid phase lipid from the region of said major net flow into the region of said minor net flow;

maintaining temperature of said minor net flow about said minor outlet sufficiently elevated for at least partially redissolving or remelting solid phase lipid within said chamber prior to said withdrawing, the ratio of lipid to solvent in said lipid and solvent withdrawn from said minor outlet being greater than that withdrawn from said major outlet.

2. The process of claim 1 wherein said lipid and solvent feed comprises an apparent solution of said lipid in said solvent.

3. The process of claim 2 wherein said apparent solution is at a temperature not substantially above the temperature required to prevent precipitation of a portion of the lipid contained therein.

4. The process of claim 1 wherein said feeding is through a single inlet intermediate to said outlets.

5. The process of claim 1 wherein said feeding is through two inlets, the first disposed to feed said major internal net flow, the second disposed to feed said minor internal net flow.

6. The process of claim 5 wherein substantially all of said lipid is fed into said chamber through said first inlet.

7. The process of claim 1 wherein said lipid is a glyceride oil.

8. The process of claim 1 wherein said solvent is acetone.

9. The process of claim 8 wherein said lipid is Sal Fat.

10. The process of claim 8 wherein said lipid is cottonseed oil.

11. The process of claim 1 wherein said solvent is methylethyl ketone.

12. The process of claim 1 wherein said solvent is 2-nitropropane.

13. The process of claim 1 wherein said solvent is methanol.

14. The process of claim 1 wherein said solvent is ethanol.

15. The process of claim 1 wherein said solvent is hexane.

16. The process of claim 1 wherein said major outlet and said minor outlet are displaced substantially vertically.

17. The process of claim 16 wherein said chamber is elongated in a substantially vertical direction.

18. The process of claim 16 wherein said lipid and said solvent in said feed have densities which differ by at least about 0.05 g/cc.

19. The process of claim 18 wherein said densities differ by at least about 0.1 g/cc.

20. The process of claim 18 wherein said major flow is directed generally upward, said minor flow is directed generally downward and said lipid is at least about 0.05 g/cc more dense than said solvent.

21. The process of claim 20 wherein said lipid is a glyceride oil.

22. The process of claim 18 wherein said major flow is directed generally downward, said minor flow is directed generally upward, and said lipid is at least about 0.05 g/cc less dense than said solvent.

23. The process of claim 1 wherein said lipid and solvent feed comprises a slurry of solid phase lipid in solvent therefor.

24. The process of claim 1 wherein said lipid is Sal Fat.

25. The process of claim 1 wherein said lipid is cottonseed oil.

* * * * *